US008825285B2

(12) United States Patent
Mougey et al.

(10) Patent No.: US 8,825,285 B2
(45) Date of Patent: Sep. 2, 2014

(54) METHOD AND APPARATUS FOR OPERATING A DRIVE DEVICE, IN PARTICULAR AN ENGINE COOLING FAN OF A MOTOR VEHICLE

(75) Inventors: Yannick Mougey, Forstfeld (FR); Trudpert Meier, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 509 days.

(21) Appl. No.: 12/936,833

(22) PCT Filed: Mar. 25, 2009

(86) PCT No.: PCT/EP2009/053479

§ 371 (c)(1),
(2), (4) Date: Nov. 2, 2010

(87) PCT Pub. No.: WO2009/124842

PCT Pub. Date: Oct. 15, 2009

(65) Prior Publication Data

US 2011/0040445 A1 Feb. 17, 2011

(30) Foreign Application Priority Data

Apr. 7, 2008 (DE) ..... 10 2008 001 024

(51) Int. Cl.
*G06F 7/00* (2006.01)

(52) U.S. Cl.
USPC ..... 701/36; 123/41.05

(58) Field of Classification Search
USPC ..... 701/36, 1; 123/41.02, 41.13, 41.48, 123/41.49, 41.65, 41.01, 41.05
See application file for complete search history.

(56) References Cited

U.S. PATENT DOCUMENTS

| | | | | |
|---|---|---|---|---|
| 5,995,896 | A * | 11/1999 | Depping et al. | 701/51 |
| 6,481,388 | B1 * | 11/2002 | Yamamoto | 123/41.12 |
| 2003/0133242 | A1 | 7/2003 | Buchholz | |
| 2007/0046230 | A1 * | 3/2007 | Tsutsui | 318/268 |
| 2009/0145376 | A1 | 6/2009 | Okuda et al. | |
| 2012/0017856 | A1 * | 1/2012 | Nicgorski | 123/41.11 |

FOREIGN PATENT DOCUMENTS

| | | | |
|---|---|---|---|
| EP | 1085180 | A2 | 3/2001 |
| GB | 2442177 | A | 3/2008 |
| JP | 62260591 | | 11/1987 |
| JP | 11107751 | | 4/1999 |
| JP | 11107753 | A | 4/1999 |
| JP | 2001193460 | A | 7/2001 |
| JP | 200444507 | A | 2/2004 |

* cited by examiner

*Primary Examiner* — Yonel Beaulieu
(74) *Attorney, Agent, or Firm* — Michael Best & Friedrich LLP

(57) ABSTRACT

The invention relates to a method and a device for operating a drive device. According to the invention, it is provided that the lower speed limit and the upper speed limit of a critical speed range of the drive device are determined when operating the drive device, that the target speed of the drive device is determined and that the operation of the drive device is done at one of the speed limits if the target speed is within the critical speed range. Through this procedure, it is for example avoided that the drive device is operated in a speed range in which the environment of the drive device or the device itself is excited into characteristic vibrations that are undesirable noise and/or vibrations.

17 Claims, 2 Drawing Sheets

METHOD AND APPARATUS FOR OPERATING A DRIVE DEVICE, IN PARTICULAR AN ENGINE COOLING FAN OF A MOTOR VEHICLE

CROSS REFERENCE TO RELATED APPLICATION

This application is a 35 U.S.C. 371 application of PCT/EP2009/053479 filed on Mar. 25, 2009.

BACKGROUND OF THE INVENTION

1. Field of the Invention

The invention relates to a method and an apparatus for operating a drive device.

2. Description of the Prior Art

In the industry, a method and an apparatus for operating a drive device in the form of an engine cooling fan for the internal combustion engine of a motor vehicle are known. The engine cooling fan serves to subject an engine radiator to an air flow, and thus to cool down the coolant, heated by the engine and circulated between the engine and the radiator and dissipate heat of the combustion process from the engine into the environment.

Typically, the drive of the engine cooling fan in modern vehicles is done by a DC motor. To reduce the energy expenditure for this electric drive, its power is adapted to the combustion heat to be dissipated from the engine at the present time.

In the simplest case, this is done by switching on the engine cooling fan only as soon as the air flow, generated by the driving situation, is no longer adequate for engine cooling, and then it is operated at a fixed rpm, which ensures adequate engine cooling in all conceivable driving and environmental situations.

However, a control in which the power of the engine cooling fan is adapted continuously during travel operation to the actual cooling power required is more favorable in energy terms. The control unit of the engine cooling fan (fan control module, FCM) used for this purpose is capable of varying the rpm of the electric drive of the engine cooling fan over a wide rpm range, for instance from 0 to 3000 $min^{-1}$. The target rpm $n_{target}$ required for the actual driving mode is then defined in the vehicle control unit (ECU) by the engine management system and transmitted as a PWM (pulse width modulation) signal to the engine cooling fan. The conversion of the rpm demand into an electrical voltage for driving the engine cooling fan then takes place in the control unit of the engine cooling fan.

The engine cooling fan is a noise source, and as such is taken into account in determining noise requirements at the vehicle level. In critical rpm ranges, because of resonance, the engine cooling fan may possibly generate an increased noise level on its own or in its surroundings. The electric drive of the engine fan can also cause vibration that matches the natural frequency of the engine cooling fan or its surroundings.

The object of the invention is to optimize the operating performance of the drive device, in particular with regard to the development of noise and other vibration.

OBJECT AND SUMMARY OF THE INVENTION

In a drive device of the type mentioned at the outset, this object is attained in that in operation of the drive device, the lower and upper limit rpms of a critical rpm range of the drive device are determined; moreover, the target rpm of the drive device is determined, and the operation of the drive device is effected at one of the limit rpms, if the target rpm is in the critical rpm range.

This procedure for instance avoids relatively long-term operation of the drive device in an rpm range in which its surroundings or the drive device itself is incited to natural vibration, which is unwanted when in the form of noise and/or vibration. If it is necessary to pass through the critical rpm range to reach one of the limit rpms, then this is done quickly, so that the impairments that occur in the process are as slight as possible.

Preferably, the method is employed whenever the drive device is an electric drive. In DC motors, the rpm change can be done in an especially simple way by adaptation of the electrical voltage.

The method of the invention is employed especially advantageously in driving an engine cooling fan, and in particular for cooling an internal combustion engine. The inertia of the cooling system is favorable to dispensing with operation in a critical rpm range. Moreover, the demands in terms of noise production by motor vehicles and other devices that have internal combustion engines are usually especially stringent.

Determining the critical rpm range can fundamentally be done during operation of the drive device as well, for instance by passing regularly through the entire rpm range and ascertaining the noises or vibration that occur in the process. In systems whose resonant behavior varies over time only insignificantly if at all, however, the upper and/or lower limit rpm is preferably ascertained in advance, for instance by a laboratory test using a suitably equipped vehicle. The thus-determined upper and/or lower limit rpm can then be electronically stored in memory in a simple way.

The target rpm of the drive device, in a special embodiment, is determined at time intervals, and in particular in periodic repetitions of 5 to 15 seconds, for instance. By comparison of the target rpm at a first time with the target rpm at a next time, it can be ascertained whether the demands made of the power of the drive device are increasing or decreasing. This criterion can be used to determine whether, to avoid the critical rpm, the drive device should be operated at the upper limit rpm or the lower limit rpm.

Thus the drive device is preferably operated at the lower limit rpm, if the target rpm is in the critical rpm range and the defined target rpm at a first time is greater than the defined target rpm at the next time. The power demand accordingly decreases with time, and thus it can be expected that the rpm demand will soon be below the lower limit rpm, anyway. Until then, the drive device is accordingly operated at the lower limit rpm, which is more favorable in terms of energy.

Likewise, for energy considerations, drive device is preferably operated at the lower limit rpm, if the target rpm is in the critical rpm range and the defined target rpm at a first time corresponds to the defined target rpm at the next time, or in other words the power demand neither increases nor decreases with time.

Advantageously, it is also provided that the drive device is operated at the upper limit rpm, if the target rpm is in the critical rpm range and the defined target rpm at a first time is less than the defined target rpm at the next time. Thus the increase in the power demanded is counteracted by already operating the drive device at the upper limit rpm, when there is a positive gradient of the rpm demand.

An apparatus suitable for performing the method is distinguished by a drive device, means for determining the target rpm of the drive device, and means for comparing the target rpm with a defined critical rpm range. In a motor vehicle, these means can be created in a simple way by adaptation of the usual control units of the vehicle, internal combustion engine and/or engine cooling fan.

The existing means can also be adapted for storing a previously defined critical rpm range in memory, for instance by storing the critical rpm range in the electronic data memories that are present there.

BRIEF DESCRIPTION OF THE DRAWINGS

The invention will be described in detail below in conjunction with the accompanying drawings, in which.

DESCRIPTION OF THE PREFERRED EMBODIMENT

Figure 1:
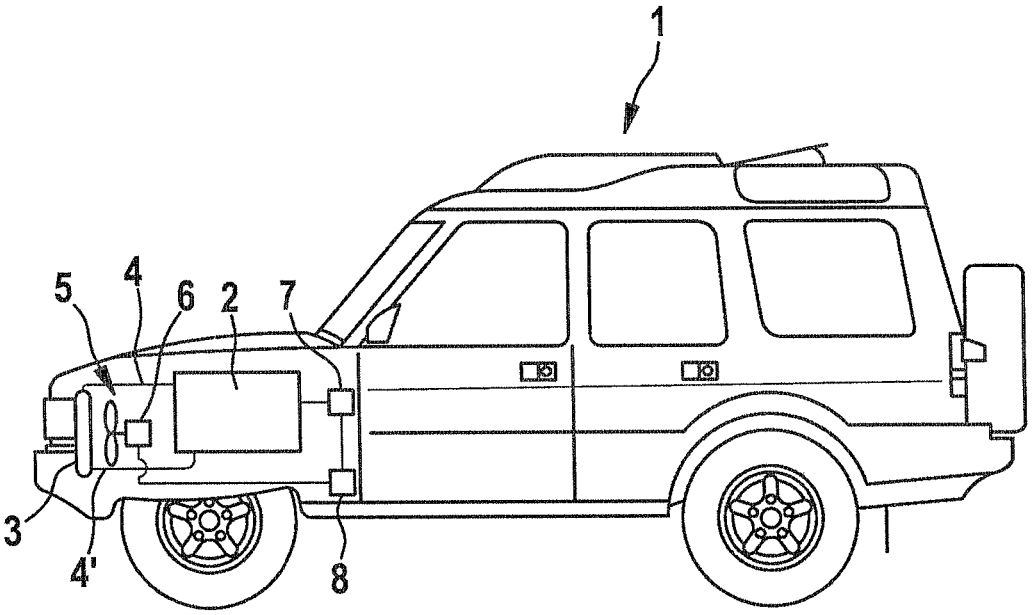
FIG. 1 depicts the illustration of a motor vehicle equipped according to the invention.

The motor vehicle 1 shown in FIG. 1 has an internal combustion engine 2 and an engine radiator 3, which communicate with one another via coolant lines 4, 4' and form a coolant loop. A vane wheel pump, not shown, circulates the coolant in the coolant loop. In the vicinity of radiator 3 is an engine cooling fan 5, with an electric drive 6. The fan, as a function of its rpm, increases the air flow through the radiator 3 and thus improves the heat dissipation from the radiator 3 into the surroundings.

The engine 2 is equipped with an electronic control unit 7 (ECU), which administers the data and processes required for operating the engine 2 and other vehicle systems (such as the airbag system). These data also include the temperature of the coolant and the resultant power demand made of the engine cooling fan 5. The central control unit 7 (ECU) in turn communicates with the controller 8 (FCM) of the engine cooling fan 5 via a BUS system.

Figure 2:
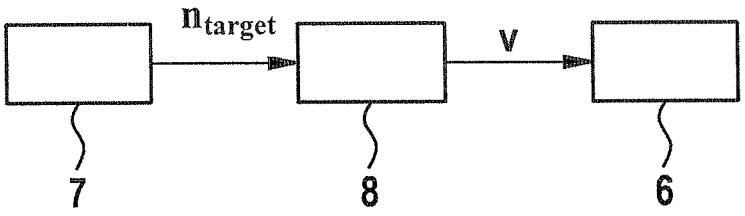
FIG. 2 is a graph showing the data transmission from the engine to the engine cooling fan.

FIG. 2 shows the forwarding and conversion of the data in detail. The target rpm $n_{target}$ determined by the control unit 7 (ECU) of the engine 2 is carried as an encoded signal to the controller 8 (FCM) of the engine cooling fan 5. On the basis of this rpm demand, the controller 8 furnishes a voltage V that is necessary for operating the drive 6 of the engine cooling fan 5 at the target rpm $n_{target}$ demanded.

Figure 3:
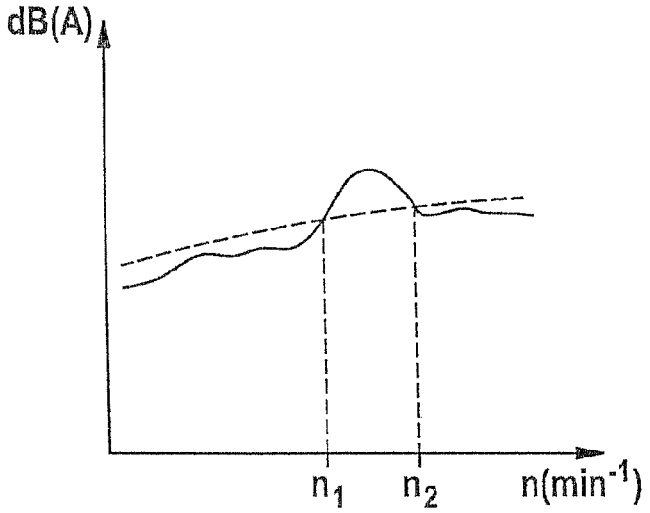
FIG. 3 is a graph showing the demanded noise level and the measured noise level over the rpm of the engine cooling fan.

As can be seen from FIG. 3, in operation of the engine cooling fan 5, the noise emissions (in dB(A)) increase with increasing rpm n (in $min^{-1}$). Even if the noise level overall is essentially below the limit represented by dashed lines, which has been specified by the vehicle manufacturer, critical rpm ranges $[n_1; n_2]$ can still exist in which because of resonance, an increase in noise emission occurs. In the exemplary embodiment, the critical rpm range $[n_1; n_2]$ is defined by the lower limit rpm $n_1$ and the upper limit rpm $n_2$ and is ascertained experimentally.

Figure 4:
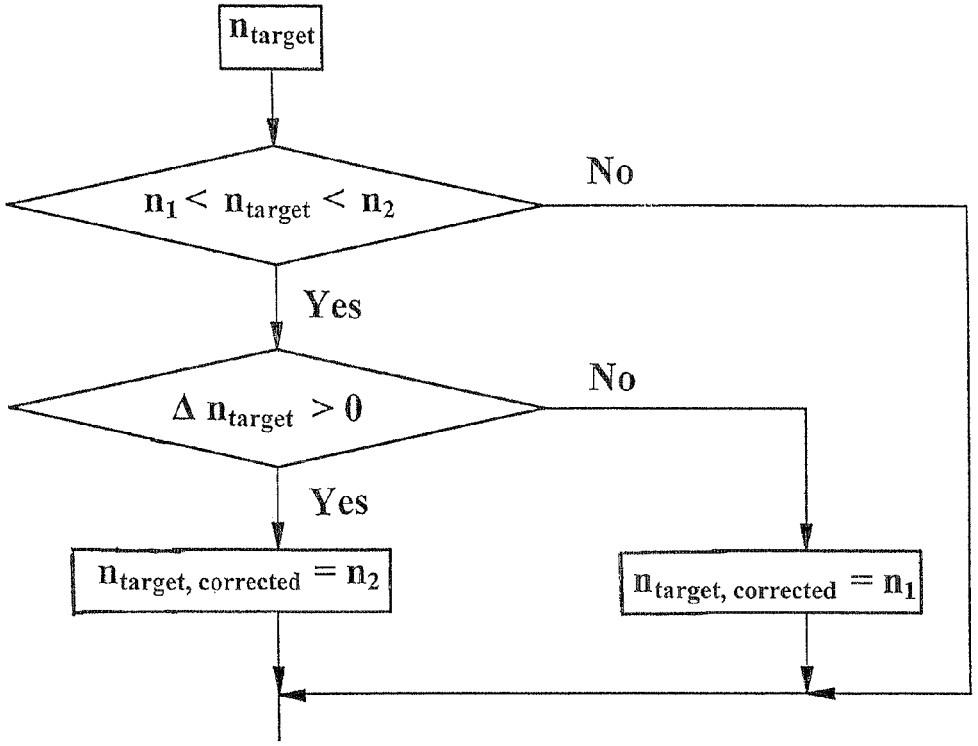
FIG. 4 is a flow chart for controlling the drive of the engine cooling fan.

The flow chart shown in FIG. 4 represents the decision chain for largely avoiding this increased noise emission. The corresponding questions can basically be asked in the control unit 7 of the engine 2, in the controller 8 of the engine cooling fan 5 (as described below), or in some other control module of the motor vehicle 1 that furnishes corresponding capacities.

The target rpm $n_{target}$ determined by the control unit 7 of the engine 2 is checked by the controller 8 of the engine cooling fan 5 for whether it is above the lower limit rpm $n_1$ and below the upper limit rpm $n_2$ and thus within the critical rpm range $[n_1; n_2]$. If not (answer: No), the rpm demand continues unchanged. The drive 6 of the engine cooling fan 5 is thus supplied with the voltage V that is required for operation at the target rpm $n_{target}$.

Conversely, if the target rpm $n_{target}$ is between the lower limit rpm $n_1$ and the upper limit rpm $n_2$ and thus within the critical rpm range $[n_1; n_2]$ (answer: Yes), then in the next method step, it is ascertained whether the gradient of the rpm demand is positive ($\Delta n_{target}=(n_{target}(t_{k+1})-n_{target}(t_k))>0$). In that case, the target rpm $n_{target}$ demanded increases from a determination at time $t_k$ to the chronologically succeeding determination at time $t_{k+1}$. If this is so (answer: Yes), then the upper limit rpm $n_2$ is defined as the corrected target rpm $n_{target,\ corrected}$, and the drive 6 of the engine cooling fan 5 is already being supplied with a somewhat too high voltage, because of the increasing need for cooling power.

Conversely, if the gradient of the rpm demand is equal to zero or is negative (answer: No), then in expectation of a constant or decreasing cooling power need, the lower limit rpm $n_1$ is defined as the corrected target rpm $n_{target,\ corrected}$. If the cooling power that now ensues proves to be too slight, then in subsequent determinations a positive gradient of the rpm demand will be established, and the limit rpm will be raised to the upper value $n_2$. A suitable algorithm prevents the corrected target rpm $n_{target,\ corrected}$ from fluctuating in rapid succession between the limit rpms $n_1$ and $n_2$.

In a modification of this method sequence, it is fundamentally also conceivable to provide the lower limit rpm $n_1$ as the corrected target rpm n $n_{target,\ corrected}$ always, as long as the target rpm $n_{target}$ demanded is within the critical rpm range $[n_1; n_2]$, and not to increase the cooling power until whenever the target rpm $n_{target}$ exceeds the upper limit rpm $n_2$. It is equally conceivable to operate with excess cooling power at all times, as long as the target rpm $n_{target}$ demanded is within the critical rpm range $[n_1; n_2]$; that is, in that case, to establish the upper limit rpm $n_2$ as the corrected target rpm $n_{target,\ corrected}$.

The foregoing relates to the preferred exemplary embodiment of the invention, it being understood that other variants and embodiments thereof are possible within the spirit and scope of the invention, the latter being defined by the appended claims.

The invention claimed is:

1. A method for operating a drive device, having the following steps:

determining, by a controller, a lower and an upper limit rpm of a critical rpm range of the drive device;

determining a target rpm of the drive device;

operating, by a controller, the drive device at a limit rpm, if the target rpm is in the critical rpm range;

wherein the drive device is a drive of an engine cooling fan;

wherein the drive device is operated at the lower limit rpm, if the target rpm is in the critical rpm range and a defined target rpm at a first time is greater than the defined target rpm at a next time; and wherein drive device is operated at the lower limit rpm, if the target rpm is in the critical rpm range and a defined target rpm at a first time corresponds to the defined target rpm at a next time.

2. The method as defined by claim 1, wherein the drive device is an electric drive.

3. The method as defined by claim 2, wherein the drive device of the drive is an engine cooling fan.

4. The method as defined by claim 1, wherein the engine cooling fan serves to cool an internal combustion engine, in particular of a motor vehicle.

5. The method as defined by claim 3, wherein the engine cooling fan serves to cool an internal combustion engine, in particular of a motor vehicle.

6. The method as defined by claim 1, wherein the lower and/or the upper limit rpm is defined in advance.

7. The method as defined by claim 2, wherein the lower and/or the upper limit rpm is defined in advance.

8. The method as defined by claim 1, wherein the lower and/or the upper limit rpm is defined in advance.

9. The method as defined by claim 4, wherein the lower and/or the upper limit rpm is defined in advance.

10. The method as defined by claim 5, wherein the lower and/or the upper limit rpm is defined in advance.

11. The method as defined by claim 6, wherein the lower and/or the upper limit rpm is stored in memory electronically.

12. The method as defined by claim 10, wherein the lower and/or the upper limit rpm is stored in memory electronically.

13. The method as defined by claim 1, wherein the target rpm is determined in preferably periodically repeating time intervals.

14. The method as defined by claim 13, wherein the drive device is operated at the upper limit rpm, if the target rpm is in the critical rpm range and a defined target rpm at a first time is less than the defined target rpm at a next time.

15. An apparatus comprising:

a drive device, an element for determining the target rpm of the drive device, and an element for comparing the target rpm with a defined critical rpm range;

wherein the drive device is operated at a limit of the critical rpm range if the target rpm is in the critical rpm range;

wherein the drive device is a drive of an engine cooling fan;

wherein the drive device is operated at the lower limit rpm, if the target rpm is in the critical rpm range and a defined target rpm at a first time is greater than the defined target rpm at a next time; and wherein drive device is operated at the lower limit rpm, if the target rpm is in the critical rpm range and a defined target rpm at a first time corresponds to the defined target rpm at a next time.

16. The apparatus as defined by claim 15, further having an element for storing a previously defined critical rpm range in memory.

17. The apparatus as defined by claim 16, wherein the element for storing the critical rpm range in memory include an electronic data memory.

* * * * *